US012584626B2

(12) United States Patent
Seeley

(10) Patent No.: US 12,584,626 B2
(45) Date of Patent: Mar. 24, 2026

(54) BURNER LINER

(71) Applicant: Edwards Limited, Burgess Hill (GB)

(72) Inventor: Andrew Seeley, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 344 days.

(21) Appl. No.: 18/247,197

(22) PCT Filed: Oct. 5, 2021

(86) PCT No.: PCT/GB2021/052569

§ 371 (c)(1),
(2) Date: Mar. 29, 2023

(87) PCT Pub. No.: WO2022/074376

PCT Pub. Date: Apr. 14, 2022

(65) Prior Publication Data

US 2023/0375174 A1 Nov. 23, 2023

(30) Foreign Application Priority Data

Oct. 7, 2020 (GB) ..... 2015884

(51) Int. Cl.
*F23D 14/14* (2006.01)

(52) U.S. Cl.
CPC .... *F23D 14/148* (2021.05); *F23D 2203/1012* (2013.01); *F23D 2203/103* (2013.01); *F23D 2203/106* (2013.01)

(58) Field of Classification Search
CPC ..... F23D 14/148; F23D 2203/1012; F23D 2203/103; F23D 2203/106
(Continued)

(56) References Cited

U.S. PATENT DOCUMENTS 3,227,149 A * 1/1966 Clark ..... A47J 37/06 126/92 R
3,312,269 A * 4/1967 Johnson ..... F23D 14/148 431/328

(Continued)

FOREIGN PATENT DOCUMENTS

CN 102798123 A 11/2012
CN 211119345 U 7/2020

(Continued)

OTHER PUBLICATIONS

British Examination Report dated Mar. 24, 2021 and Search Report dated Mar. 23, 2021 for corresponding British Application No. GB2015884.6, 7 pages.

(Continued)

*Primary Examiner* — Avinash A Savani
(74) *Attorney, Agent, or Firm* — Theodore M. Magee; Westman, Champlin & Koehler, P.A.

(57) ABSTRACT

The present invention provides a foraminous burner liner for a gas abatement system. The burner liner comprises a hollow body defined by a wall, the wall comprising a plurality of interconnected substantially concentric layers. Each layer of the wall comprises a substantially regular openwork mesh; wherein the substantially regular openwork mesh of each layer is configured such that it is out of phase with one or more adjacent layers, and wherein the wall comprises sufficient layers arranged such that the wall is optically opaque when viewed externally in any radially inward direction normal to the wall.

9 Claims, 10 Drawing Sheets

(58) Field of Classification Search
USPC ..... 431/328
See application file for complete search history.

(56) References Cited

U.S. PATENT DOCUMENTS

| | | | | |
|---|---|---|---|---|
| 3,783,969 | A * | 1/1974 | Pall | B07B 1/4663 415/119 |
| 3,975,140 | A | 8/1976 | Placek | |
| 5,591,025 | A * | 1/1997 | Invernizzi | F23D 14/46 431/329 |
| 5,603,905 | A | 2/1997 | Bartz et al. | |
| 8,746,013 | B2 | 6/2014 | Geremew et al. | |
| 2005/0017203 | A1 | 1/2005 | Aust | |
| 2007/0190469 | A1 | 8/2007 | Clark et al. | |
| 2020/0011525 | A1 | 1/2020 | Horikawa et al. | |

FOREIGN PATENT DOCUMENTS

| | | | |
|---|---|---|---|
| DE | 464692 | C | 8/1928 |
| GB | 2532776 | A | 6/2016 |
| GB | 2538843 | A | 11/2016 |
| JP | H0842815 | A | 2/1996 |
| JP | 1999-159734 | A | 6/1999 |
| WO | 2006013355 | A1 | 2/2006 |
| WO | 2012069970 | A1 | 5/2012 |
| WO | 2016156811 | A1 | 10/2016 |
| WO | 2017052398 | A1 | 3/2017 |
| WO | 2018180915 | A1 | 11/2019 |

OTHER PUBLICATIONS

PCT Notification of Transmittal of the International Search Report and the Written Opinion of the International Searching Authority, or the Declaration PCT Search Report and PCT Written Opinion dated Jan. 21, 2022 for corresponding PCT application Serial No. PCT/GB2021/052569, 12 pages.

Taiwanese Office Action and Search Report dated Apr. 1, 2025 for corresponding Taiwanese application Serial No. 110137324, 13 pages.

Japanese Office Action Notification of Reason for Rejection dated Jul. 10, 2025 for corresponding Japanese Patent Application No. 2023-520322, 8 pages.

Korean Office Action dated Nov. 24, 2025 for corresponding Korean patent application No. 2023-7011549, 12 pages.

* cited by examiner

6

23

BURNER LINER

CROSS-REFERENCE OF RELATED APPLICATION

This application is a Section 371 National Stage Application of International Application No. PCT/GB2021/052569, filed Oct. 5, 2021, and published as WO 2022/074376A1 on Apr. 14, 2022, the content of which is hereby incorporated by reference in its entirety and which claims priority of British Application No. 2015884.6, filed Oct. 7, 2020.

FIELD

The present invention relates to gas abatement system radiant burners and, in particular, a foraminous burner liner, a method of designing a foraminous burner liner, and method of manufacturing a foraminous burner liner.

BACKGROUND

Radiant burners are known and are typically used for treating an effluent gas stream from a manufacturing processing tool used in, for example, the semiconductor or flat panel display manufacturing industry. During such manufacturing, residual compounds exist in the effluent gas stream pumped from the process tool.

Known radiant burners use combustion to remove the compounds from the effluent gas stream. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner liner to effect flameless combustion at the exit surface, with the amount of air passing through the foraminous burner liner being sufficient to consume not only the fuel gas supply to the burner, but also all the combustibles in the gas stream mixture injected into the combustion chamber.

Typically, the foraminous burner liner is made from a laid-up accretion of fibres or a polyurethane foam, which may be variously powder coated and sintered, or unsintered.

The inventors have found that known liners suffer from a number of drawbacks. For instance, both fibre-based and foam liners are typically formed from sheets which leads to the presence of a join-line, affecting their macro-uniformity. While, because both the fibre layup and foam forming processes are random or pseudorandom, to date, altering the properties of burner liners relies on operator experience and an element of trial and error.

The present invention addresses at least in part these and other issue with the prior art.

The discussion above is merely provided for general background information and is not intended to be used as an aid in determining the scope of the claimed subject matter. The claimed subject matter is not limited to implementations that solve any or all disadvantages noted in the background.

SUMMARY

In a first aspect the present invention provides a foraminous burner liner for a gas abatement system. The foraminous burner liner comprises a hollow body defined by a wall. The wall comprises a plurality of interconnected substantially concentric layers, wherein each layer of the wall comprises a substantially regular openwork mesh. The substantially regular openwork mesh of each layer is configured such that it is out of phase with one or more adjacent layers. Additionally, the wall comprises sufficient layers arranged such that the wall is optically opaque when viewed externally in any radially inward direction normal to the wall.

In a second aspect, the invention provides a foraminous burner liner for a gas abatement system, said burner liner comprising a hollow body defined by a wall, said wall comprising a plurality of interconnected layers, wherein a layer comprises at least one right-handed substantially helical strut coupled to at least one left-handed substantially helical strut.

The invention further provides a method of manufacturing a foraminous burner liner according to the previous aspects, preferably by additive manufacturing.

Advantageously, the foraminous burner liners and methods of manufacturing disclosed herein may provide a regular structure that emulates the random structure of prior art foam and fibre layup burner liners, thereby allowing the control of burner properties in a predictable manner, simplifying optimisation, and avoiding the need for trial and error experimentation associated with known burner liner designs.

The result is structure that may support combustion, with uniform inner-face surface firing rate, low back-face temperature and minimum thickness. As few as six layers may achieve near optical blindness, with three times the amount needed for optical blindness providing a sufficiently low back-face temperature. An object of the design may be to achieve maximum thermal conductivity within a layer whilst minimising the conductivity layer to layer. Typically, in use, the back-face temperature (i.e. the temperature of the outmost face of the wall) will be approximately ambient temperature (e.g. 22° C.). Typically, in use, the inner-face (e.g. the innermost face of the wall) will be at a temperature of from about 800° C. to about 1000° C. Fuel and air typically flow from the back-face to the inner-face for combustion.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The invention will be described further by reference to the following figures which are intended to be non-limiting.

DETAILED DESCRIPTION

Figure 1:
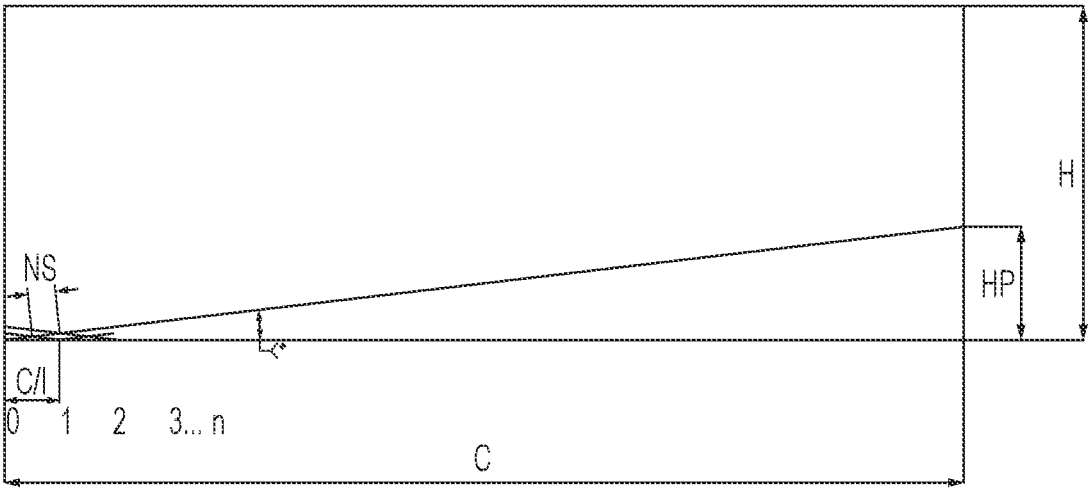
FIGS. 1 and 2 provide a schematic representation of a foraminous burner layer.

The present invention provides a foraminous burner liner for a gas abatement system. The burner liner comprises a hollow body defined by a wall. The wall comprises a plurality of interconnected layers.

Each layer of the wall defining the hollow body may comprise a substantially regular openwork mesh. Typically, the mesh will comprise a plurality of struts and nodes arranged to form a porous mesh. The mesh may consist of one or more repeat units, preferably each repeat unit is substantially identical, preferably each repeat unit comprises a plurality of struts and nodes defining one or more pores or voids. Typically, the volume fraction of void(s) is(are) relatively large compared to the volume fraction of the repeat unit, preferably a majority of the repeat unit by volume is void.

Preferably, the foraminous burner liner is optically opaque when viewed externally in any radially inward direction normal to the outermost surface of the wall. Thus, the wall may comprises sufficient layers arranged such that there is no linear radially inward path from an outermost surface of the wall to an innermost surface of the wall that is not blocked (i.e. intersected) by at least one strut and/or node forming a part of the wall. An openwork mesh has voids or pores that provide a linear radially inward path through the entire thickness of the layer. Accordingly, a single layer of the foraminous burner liner wall alone cannot be both an openwork mesh and optically opaque.

The minimum number of layers required to achieve optical opacity may be affected by the diameter of the struts and the phase offset between adjacent layers.

Preferably, the wall comprises a greater number of layers than the minimum required to achieve optical opacity, preferably at least twice the number of layers required to achieve optical opacity, more preferably at least three times the number of layers required to achieve optical opacity. Typically, the wall comprises at least three layers, for instance from about 3 to about 20 layers, preferably from about 4 to about 12 layers, more preferably from about 4 to about 9 layers.

Advantageously, three times optical opacity provides a sufficiently low back face temperature (e.g. approximately ambient temperature) during use.

The openwork mesh of each layer may be configured so that it is out of phase with one or more adjacent layers. That is to say, the repeat units of adjacent layers are not aligned when viewed in a radially inward direction normal to the outer surface of the layer. Instead, typically, a repeat unit of one layer will be circumferentially offset from a repeat unit of an adjacent layer such that the nodes of adjacent layers are not aligned when viewed in a radially inward direction normal to the outermost layer of the wall.

Preferably, at least a portion of the corresponding struts of repeat units in adjacent layers will at least partially but not fully overlap when viewed in a radially inward direction normal to the outermost layer of the wall. The circumferential offset between adjacent layers may be referred to as the inter-layer pitch. Typically, the inter-layer pitch is from about 5% to about 30% of the strut diameter, about 10% being an example.

Preferably, the mesh is substantially continuous about an entire layer. Advantageously, there may be no join line in each layer.

Preferably, a layer comprises at least one right-handed substantially helical strut coupled to at least one left-handed substantially helical strut, preferably a plurality of right-handed substantially helical struts coupled to at least one left-handed substantially helical struts.

When a layer comprises two or more right-handed substantially helical struts coupled to two or more left-handed substantially helical struts, preferably the right-handed struts are substantially parallel, and the left-handed struts are substantially parallel.

Preferably, the right-handed struts of each layer are substantially parallel to right-handed struts of each other layer. Preferably, the left-handed struts of each layer are substantially parallel to left-handed struts of each other layer.

Preferably, the right-handed and left-handed struts of each layer each have the substantially the same helix pitch. The pitch of a helix may be defined as the height of one complete helix turn, measured parallel to the axis of the helix.

The right-handed helical struts and left-handed helical struts of a layer may also be circumferentially offset by an in-layer pitch. Typically, the in-layer pitch may be the same or different to the inter-layer pitch.

Herein a right-hand helix or a left-hand helix may be referred to as an instance. A layer of the wall may comprise one or more instances, typically two or more instances. Preferably from about 6 to about 400 instances, more preferably from about 8 instances to about 120 instances. Reducing the number of instances in a layer will increase the node separation for a given helical pitch and burner liner circumference. The number of instances will typically be higher for burner liners with a relatively high helical pitch (from about 100 to 400 instances) and lower for those with a relatively low helical pitch (from about 6 to about 20 instances). Generally, the higher the number of instances per layer the lower the number of layers required to achieve optical opacity for a given strut diameter and in-layer pitch.

As discussed, the in-layer pitch and inter-layer pitch may be substantially the same. Preferably, the in-layer pitch is from about 5% to about 30% of the strut diameter, about 10% being an example.

As well as contributing to the number of layers required for optical opacity, an inter-layer pitch and in-layer pitch of greater than zero ensures that the helical struts may intersect adjacent helical struts at the nodes. That is to say, the struts overlap at the nodes in a radial direction relative to the longitudinal axis of the burner liner.

The amount of overlap contributes to both the structural integrity and the radial heat conductivity of the wall. Accordingly, a balance may be struck between the two properties depending on the material selection, size and intended use of the burner, and the like. An overlap in a radial direction relative to the longitudinal axis of the burner liner of approximately 10% of the diameter of the strut, preferably from about 5% to about 15%, has been found to be advantageous, in particular in low helical pitch embodiments.

Conversely, an in-layer overlap of approximately 100%, for instance greater than about 90%, or greater than about 95% of the width of a strut has also been found to be advantageous, particularly for relatively high helical pitch embodiments comprising relatively high number of instances per layer.

For the purpose of the invention, a relatively low helical pitch may be considered to one with a pitch angle of from about X to about Y.

Additionally, or alternatively, a relatively high helical pitch may be considered to be one with a pitch angle of greater than Y, preferably from about V to about W.

As discussed, in embodiments, each layer may comprise a plurality of right-handed substantially helical struts coupled to a plurality of spaced left-handed substantially helical struts. Additionally, one or more substantially helical struts of each layer may intersect with and be integrally formed with a substantially helical strut of an adjacent layer. Preferably each substantially helical strut intersects with and is integrally formed with a substantially helical strut of an adjacent layer.

In alternative embodiments, one or more radially extending spacers may couple a first layer to an adjacent layer. Typically, a plurality of circumferentially separated radially extending spacers separate the first layer from the adjacent layer. Said radially extending spacers are in the form of an intermediate spacing layer(s), separating each adjacent primary layer of the wall.

Preferably the spacers are generally uniformly spaced about and coupled to the outer surface of an inner of the two layers and the inner surface of the outer of the two layers. The spacers typically separate one layer from an adjacent layer by a radial distance substantially equal to the spacer's diameter and/or radial thickness. Where there are multiple intermediate spacer layers in the foraminous burner, preferably the spacers of neighbouring intermediate spacer layers are circumferentially offset. Spacers may advantageously reduce radial/inter-layer conduction of heat, such as when the node-to-node separation is relatively low, and/or increase the thermal path through the burner.

The radially extending spacer(s) may be in the form a stave, typically a longitudinally extending stave. Typically, the longitudinally extending stave may be substantially straight, although they may equally be in the form of a helix or part thereof.

Intermediate spacer layer(s) are typically used in the wall of a foraminous burner liner with low node separation, e.g. less than about 4 mm, preferably from about 1 mm to about 4 mm.

As the skilled reader will appreciate, the size of the wall of a foraminous burner liner will depend upon the intended use and so the invention is not intended to be limited to any specific wall geometry. However, typically a foraminous burner liner wall will be generally tubular with a substantially annular cross-section. The radial thickness of the wall is typically relatively small compared to the radius of the tube it provides.

Typically, the wall of a foraminous burner liner will have an axial length of from 50 mm to about 500 mm, more preferably from about 60 mm to about 200 mm, about 75 mm and about 150 mm being examples.

The inside diameter of the wall of the foraminous burner liner may be from about 50 mm to about 250 mm, preferably from about 100 mm to about 200 mm, about 150 mm and about 175 mm being examples.

Typically, the aspect ratio (i.e. the ratio of the inside diameter of the wall to its height) is from about 5:1 to about 1:5, such as from about 3:1 to about 1:3. Aspect ratios of greater than 1:1 are preferred, such as from about 1:1 to about 1:5, or preferably from about 2:3 to about 1:3.

The radial thickness of the wall of the foraminous burner liner may preferably be from 1 to about 10 mm, preferably from about 2 mm to about 6 mm.

Without wishing to be being bound by theory, the number of helix turns completed by each substantially helical strut in each layer will be determined by its helix pitch and the aspect ratio of the foraminous burner liner. For instance, a relatively low pitch helix may perform a relatively high number of helix turns for a given length of burner liner, whereas a relatively high pitch helix will perform a lower number of helix turns for a burner of the same length.

There may be provided a foraminous burner liner wherein a right-handed substantially helical strut and a left-handed substantially helical strut of each layer each complete more than one complete helix turns. Alternatively, each substantially helical strut may complete a part of a helix turn, preferably one or less helix turns.

Figure 2:
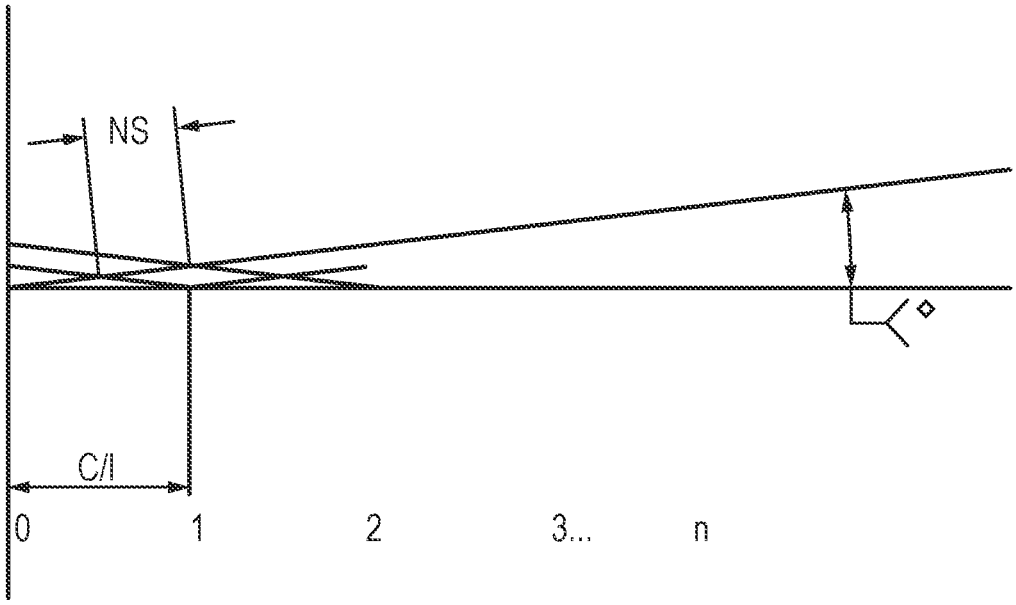

Referring to FIGS. 1 and 2 which, for the purposes of understanding, show an unrolled layer which has laid out flat, where:

H=Height

HP=Helical Pitch $<^{o}$=Pitch Angle=$\mathrm{Tan}^{-1}(HP/C)$

C=Circumference=$\pi \cdot D$

D=Diameter

C/I=Circumference divided by the number of Instances

I=Instances (of LH or RH helices in a layer)

NS=Nodal Separation=$(C^2+HP^2)^{0.5}/(2\times I)$ n=Start angle, calculated as ((360/Instances)/(Offsets−1) =0, n, 2n, 3n etc Table 1, by way of non-limiting example, illustrates how adjusting various parameters of the burner liner, including the inside diameter, height, wire diameter, in-layer pitch, instances, layers, and interlayer pitch, facilitates control of the node separation, density, and node separation relative to wire size. It is of note for instance that the node separation may be increased or decreased significantly without affecting the volume density of the burner liner to the same degree.

TABLE 1

| | | Shallow Angle Structures | | | | | Steep Angle Structures | | |
|---|---|---|---|---|---|---|---|---|---|
| | | 1 | 2 | 3 | 4 | 5 | 6 | 7 | 8 |
| Inside Diameter | mm | 75 | 75 | 75 | 75 | 75 | 75 | 75 | 75 |
| Height | mm | 75 | 75 | 75 | 75 | 150 | 75 | 75 | 75 |
| Wire Diameter | mm | 0.3 | 0.3 | 0.45 | 0.6 | 0.3 | 0.3 | 0.45 | 0.6 |
| In-layer Pitch | mm | 0.27 | 0.27 | 0.405 | 0.54 | 0.27 | 0 | 0 | 0 |
| Turns | | 3 | 3 | 3 | 3 | 6 | 0.3 | 0.3 | 0.3 |
| Helical Pitch | mm | 25 | 25 | 25 | 25 | 25 | 250 | 250 | 250 |
| Instances | | 24 | 18 | 12 | 9 | 24 | 120 | 90 | 60 |
| Layers | | 11 | 11 | 11 | 11 | 11 | 11 | 11 | 11 |
| Start Angles* | n | 7.5 | 10 | 15 | 20 | 7.5 | 1.5 | 2 | 3 |

TABLE 1-continued

| | | Shallow Angle Structures | | | | | Steep Angle Structures | | |
|---|---|---|---|---|---|---|---|---|---|
| | | 1 | 2 | 3 | 4 | 5 | 6 | 7 | 8 |
| Offsets** | | 3 | 3 | 3 | 3 | 3 | 3 | 3 | 3 |
| Radial Spacers (staves) | | | | | | | 24 | 24 | 24 |
| Inter-layer pitch | mm | 0.27 | 0.27 | 0.405 | 0.54 | 0.27 | 0.27 | 0.405 | 0.54 |
| Density (approx.)/ vol % | | 75 | 81 | 81 | 82 | 75 | 81 | 78 | 80 |
| Node Separation | mm | 4.93 | 6.58 | 9.87 | 13.16 | 4.93 | 1.43 | 1.91 | 2.86 |
| Node Separation relative to wire size | | 16.45 | 21.93 | 21.93 | 21.93 | 16.45 | 4.77 | 4.24 | 4.77 |

*start angles calculated as ((360/Instances)/(Offsets-1) 0, n, 2n, 3n etc.

**arbitrary parameter based on wire thickness and wire separation to achieve blindness Accordingly, the skilled person may tune the properties of the burner liner in a predictable way addressing problems identified with known foraminous burners.

Preferably the foraminous burner liner wall has a volume density of from about 65% to about 90%, more preferably from about 70% to about 85%. This can be calculated by comparing the calculated mass of the porous structure with that of a solid cylinder of the same nominal dimensions.

Figure 3:
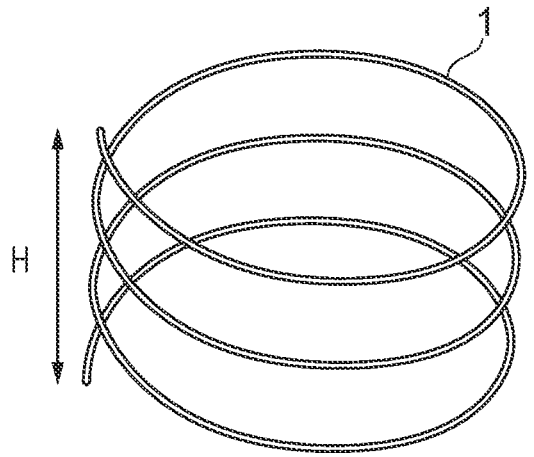
FIG. 3 shows a single left-handed helix of a foraminous burner liner.

Turning to FIG. 3 which illustrates a left-hand substantially helical strut (1). The helix (1) has a height (H) of 75 mm and a helical pitch of 25 mm. Thus, the illustrated helix (1) has three helix turns. The strut diameter is 0.3 mm.

Figure 4:
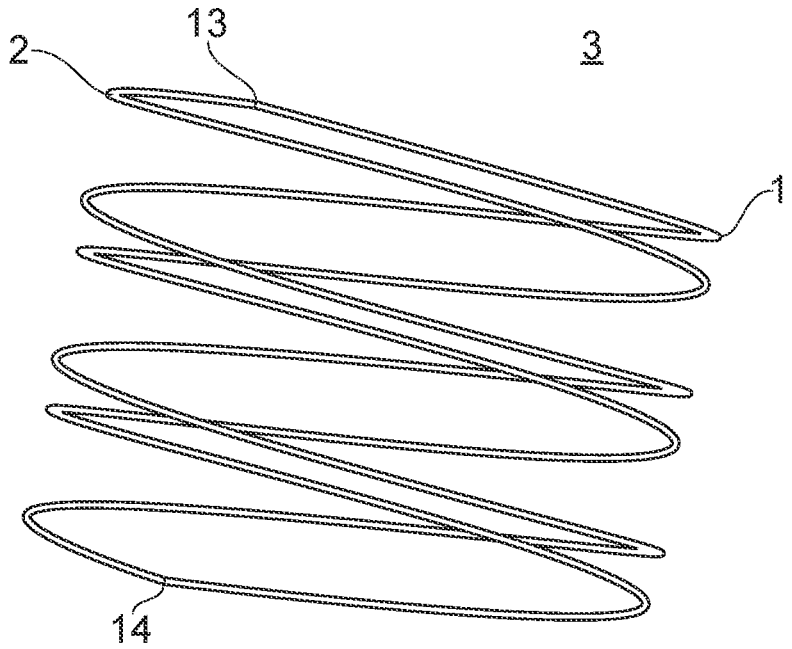
FIG. 4 shows a left-handed and a right-handed helix of a foraminous burner liner.

FIG. 4 shows a right-handed helical strut (2) coupled to the left-handed helical strut (1) of FIG. 2, so as to form a pair of helix instances (3). The right-hand helix (2) is substantially identical to the left-hand helix (1), save their handedness. The in-layer offset is 0.27 mm such that where the substantially helical struts overlap, they do so by about 10% of their diameter. Preferably, the substantially helical struts of an instance pair meet at one end in an end-to-end face-to-face configuration. In the embodiment shown in FIG. 3 both ends of the helical struts forming the instance pair meet in an end-to-end face-to-face configuration.

While not essential, preferably every helical strut of a layer starts at a node (13) and/or ends at a node (14), preferably every helical strut of every layer of the wall starts at a node and/or ends at a node. Such a configuration may ease manufacture and/or improve structural robustness.

Figure 5:
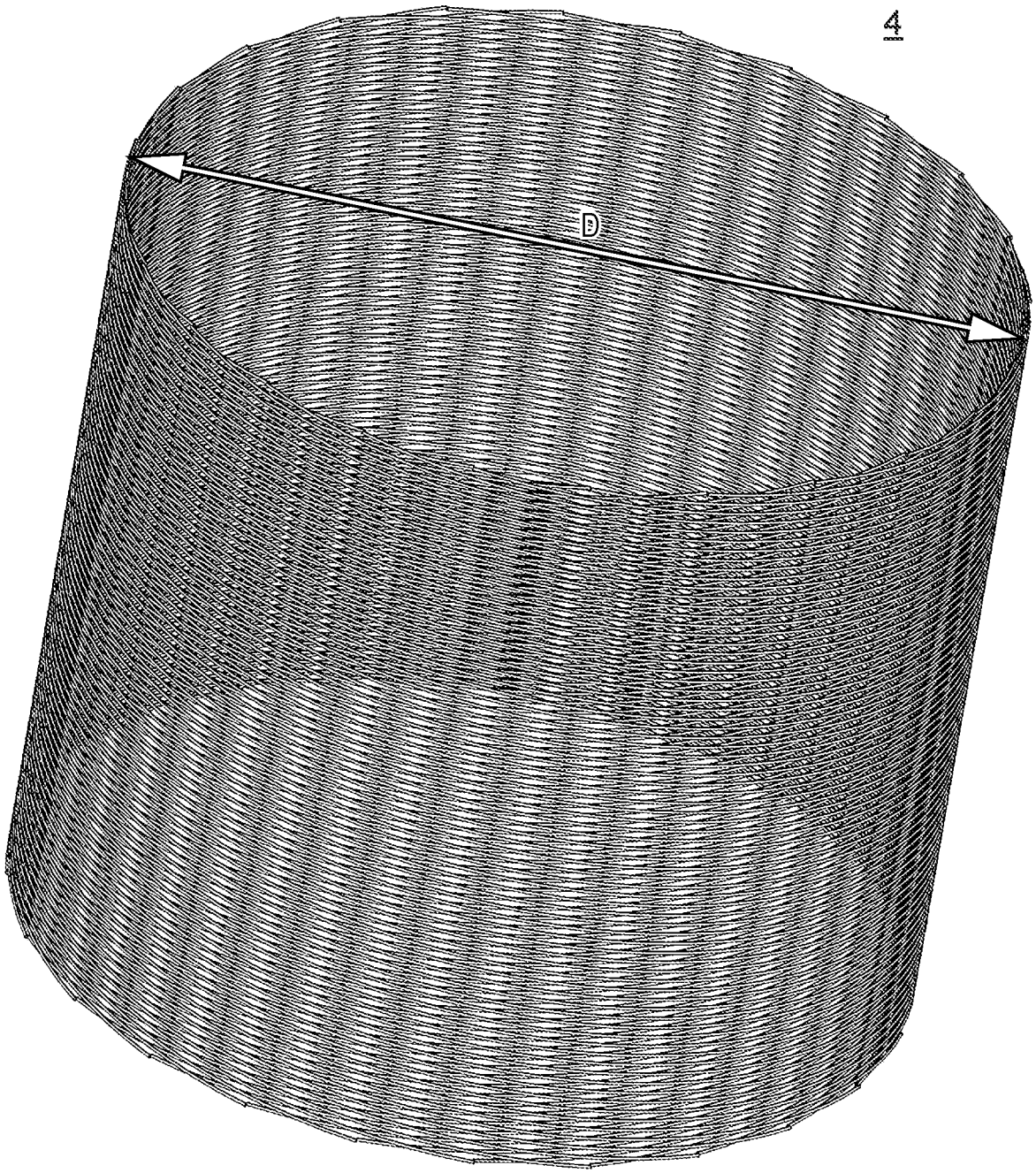
FIG. 5 shows one layer of a foraminous burner liner.

FIG. 5 shows a layer comprising twelve instance pairs (twenty-four helix instances) according to FIG. 3. This layer is the innermost layer of a wall. The wall has an inside diameter (D) of 75 mm. The helical struts are all of generally circular cross-section. The helical struts all have substantially identical diameter (e.g. 0.3 mm).

Figure 6:
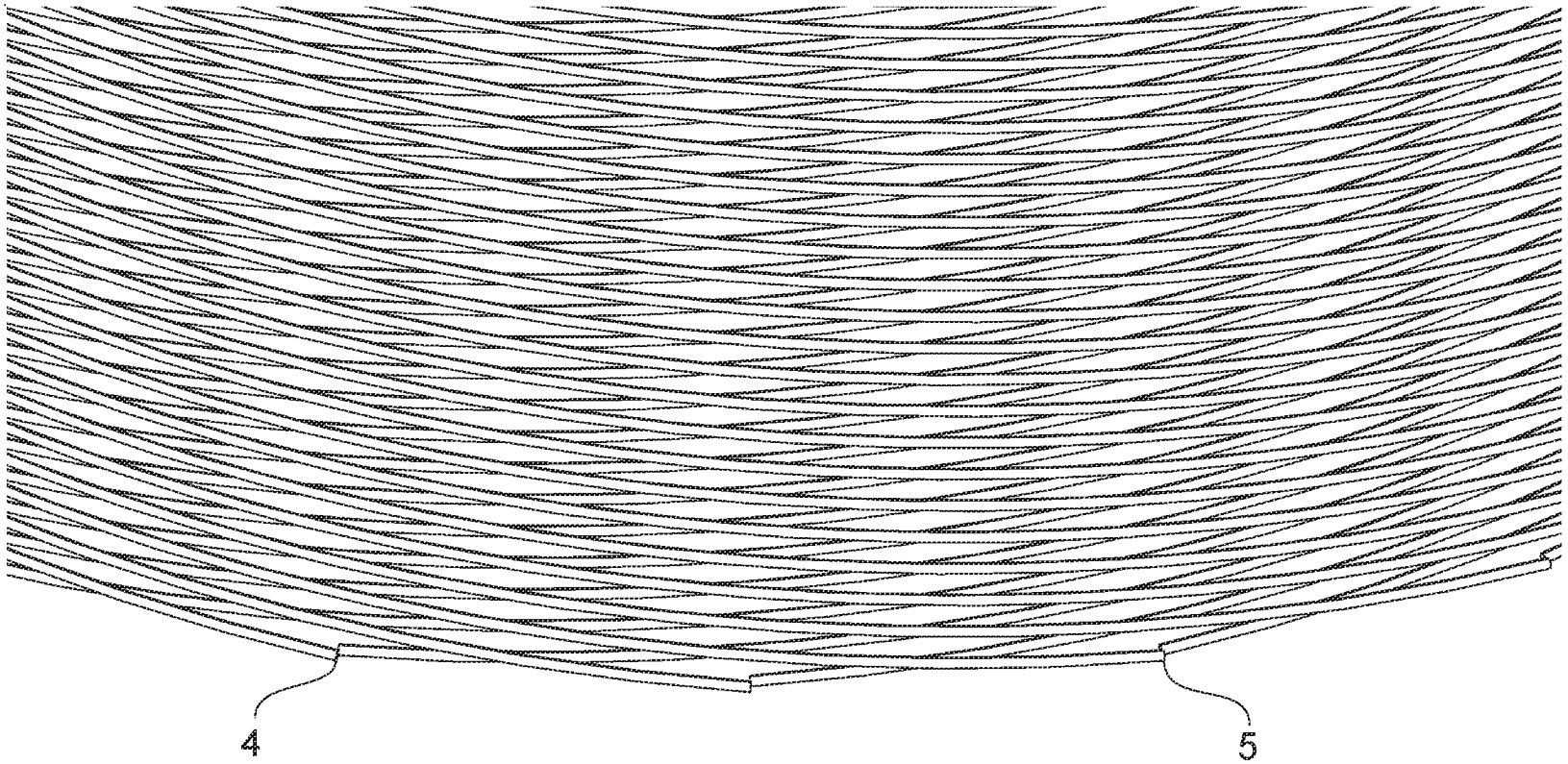
FIG. 6 shows two layers of a foraminous burner liner.

FIG. 6 shows the first layer (4) of FIG. 5 surrounded by a second layer (5). In the illustrated embodiment, the second layer (5) comprises the same number of instances as the innermost layer (4). Typically, each layer will comprise the same number of instances, although they may equally increase or decrease in a radially outward direction.

The inter-layer pitch between the first layer and the second layer is 0.27 mm. The in-layer offset is 0.27 mm. Thus, where struts of adjacent layers form nodes they overlap by about 10% of their diameter.

As can be seen by providing a second layer (4) which is offset from the innermost layer, the optical transparency of the burner liner may be reduced. That is to say, there is a reduction in the area of the outer layer from which there is direct, unobscured path to the longitudinal axis of the burner liner when viewed in a radially inward direction.

As discussed previously, preferably the foraminous burner liner comprises enough layers to be optically opaque. Advantageously, this means there are no direct radial paths from an outside surface the burner liner to an inside surface of the burner liner, which could lead to localised overheating.

Figure 7:
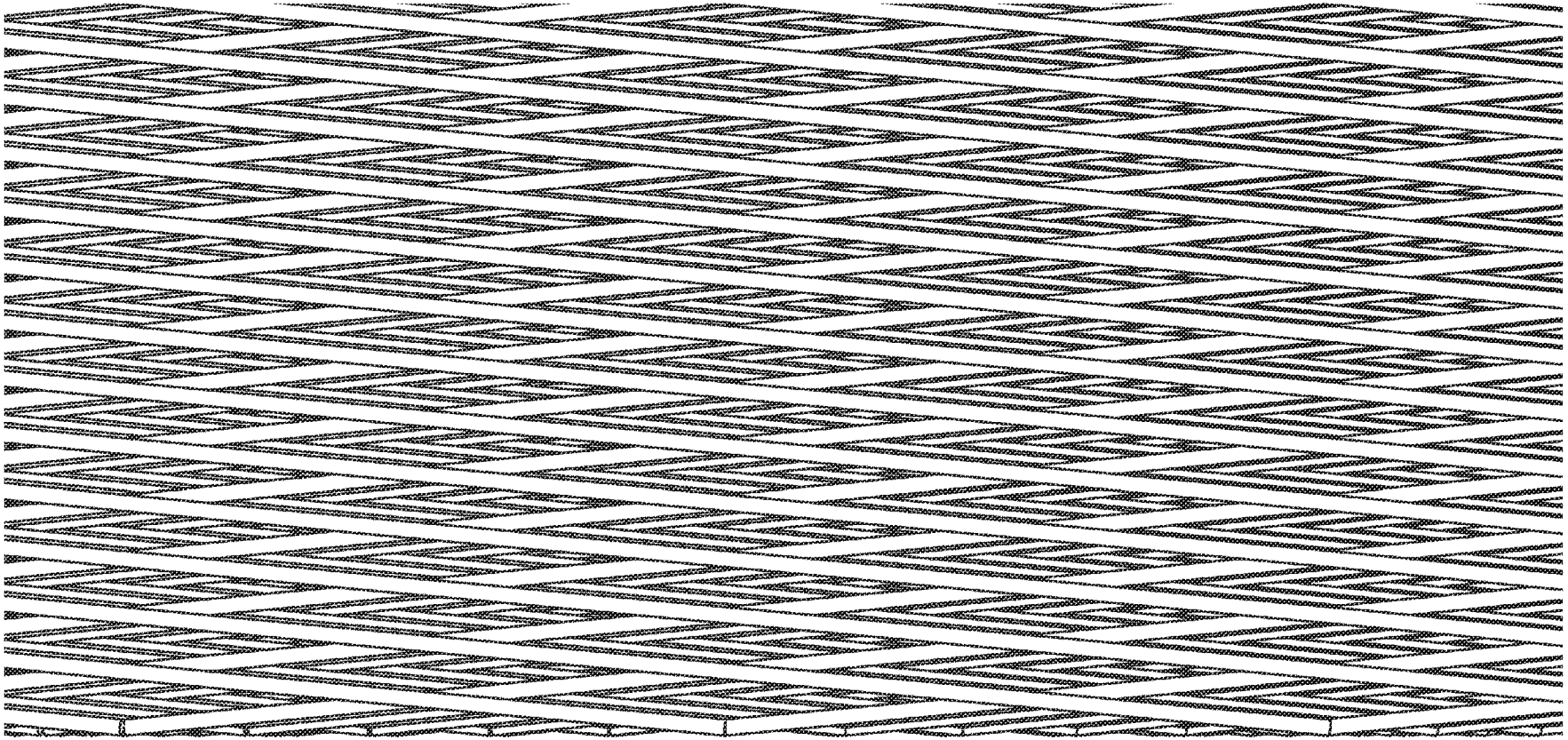
FIG. 7 shows a ten layer foraminous burner liner.

FIG. 7 shows a foraminous burner liner wall (6) comprising layers shown in FIGS. 5 and 6 built-up to ten concentric layers. This burner liner wall is optically opaque in any radially inward direction normal to the outside surface of the wall.

Preferably, a foraminous burner liner comprises at least three times the minimum number of layers required to achieve optical opacity for the selected layer configuration, each multiple individually being referred to herein as an opacity group. The minimum number of layers required to achieve optical opacity can be calculated using finite element analysis. The wall may comprise about 9 to about 25 layers.

Advantageously, as can be seen, the foraminous burner liner comprises no join line because each layer is substantially uniform and continuous. A lack of join line may improve the macro uniformity of the burner liner and ultimately its performance. In embodiments, the burner liner may be substantially transversely isotropic.

Figure 8:
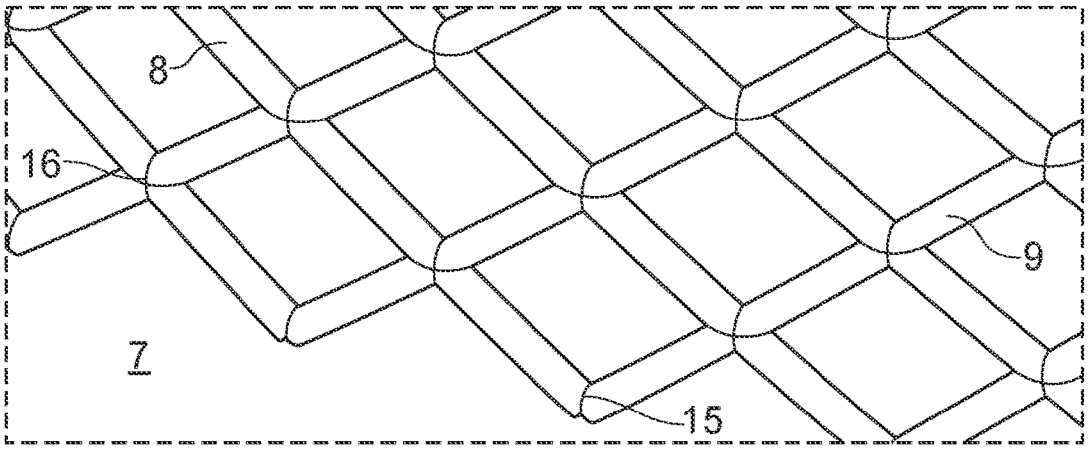
FIG. 8 shows an innermost layer of an alternative foraminous burner liner.

FIG. 8 shows an innermost layer (7) from a foraminous burner with an alternative configuration.

As illustrated, the layer (7) comprises a plurality of left-handed (8) and right-handed (9) helical struts. In this example, the inlayer overlap of the substantially helical struts is about 100%. That is to say, the helical struts pass straight through each other at each node (16). The height of the foraminous burner liner is again 75 mm; however, the helical pitch is 250 mm, such that each helical struct completes 0.3 helix turns. The helical struts have a diameter of 0.3 mm. There are 120 instances in the layer. This may be considered a relatively steep angle (high pitch) structure. Such structures may be advantageous because they may be more readily additive manufactured.

As in the previous embodiment, the substantially helical struts meet at one end in an end-to-end face-to-face configuration.

Preferably, every helical strut of a layer starts at a node and/or ends at a node (15), preferably every helical strut of every layer of the wall starts at a node and/or ends at a node. Such a configuration may ease manufacture and/or improve mechanical strength and structural robustness.

As can be seen from the figures and Table 1, the node separation provided by this type of arrangement may be significantly smaller than within the arrangement illustrated in FIGS. 1 to 7.

A smaller node separation may contribute to higher thermal conductivity.

Figure 9:
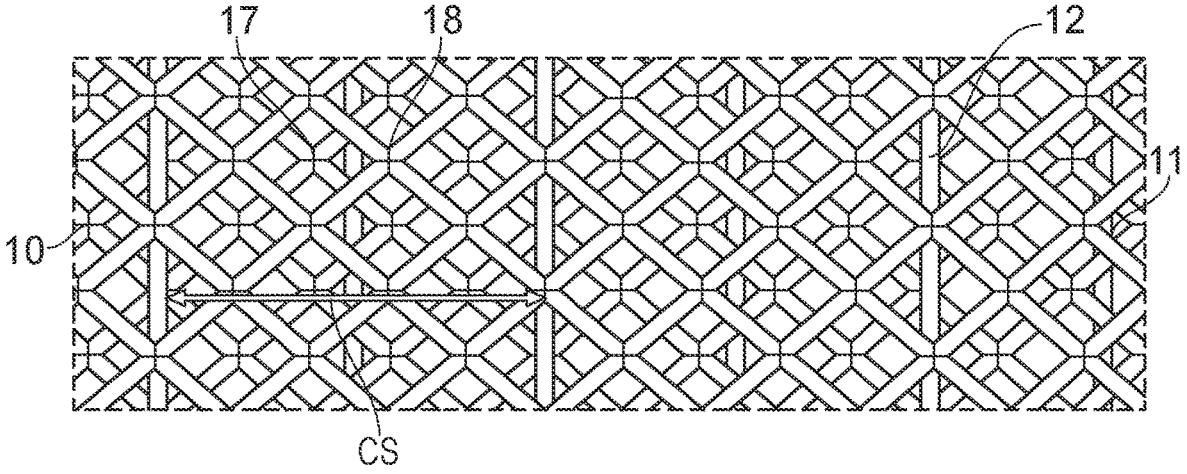
FIG. 9 show two layers of a burner liner with intermediate spacer layers.

The illustrated open work mesh has a repeat unit with a diamond unit cell. As can be seen in FIGS. 8 and 9, the illustrated repeat units within a layer are substantially identical. Similarly, the repeat units of each layer are substantially identical to the repeat units of adjacent layers.

In embodiments, an adjacent layer may be formed directly on an outer surface of an inner layer.

Alternatively, as illustrated in FIG. 9, radially adjacent layers (10, 11) may be coupled together using one or more radially extending spacers (12). In the illustrated embodiment the radially extending spacers (12) are in the form of one or more longitudinally extending staves (12). The illustrated staves are substantially straight.

The circumferential separation (CS) of the radially extending spacers (12) is the same or greater than the node separation (NS) of the layer(s), preferably greater than the node separation (NS) of the layers, preferably at least twice the node separation (NS) of the layers.

In embodiments, the radially extending spacers (12) may be considered to be in the form of an intermediate spacer layer(s) separating the primary layers (10, 11) (i.e. those formed from the substantially helical struts) of the wall. Preferably each intermediate spacer layer (12) may comprise from about 10 to about 50 longitudinally extending staves, preferably from about 20 to about 30 longitudinally extending staves, 24 being an example. Preferably, the longitudinally extending staves of a spacer layer are substantially uniformly circumferentially separated (i.e. evenly spaced about the circumference of the layers to which they are attached).

Preferably, the longitudinally extending staves have circumferential spacing of from about 5 to about 20 mm, 10 mm an example. The diameter of the staves may be greater or smaller than the diameter of the substantially helical struts, although preferably they are substantially the identical.

Advantageously, the provision radially extending spacers may significantly reduce the layer-to-layer thermal conductivity of the wall and/or further increase the tuneable characteristics of the foraminous burner liner and/or improve the structural integrity of the wall.

Figure 11:
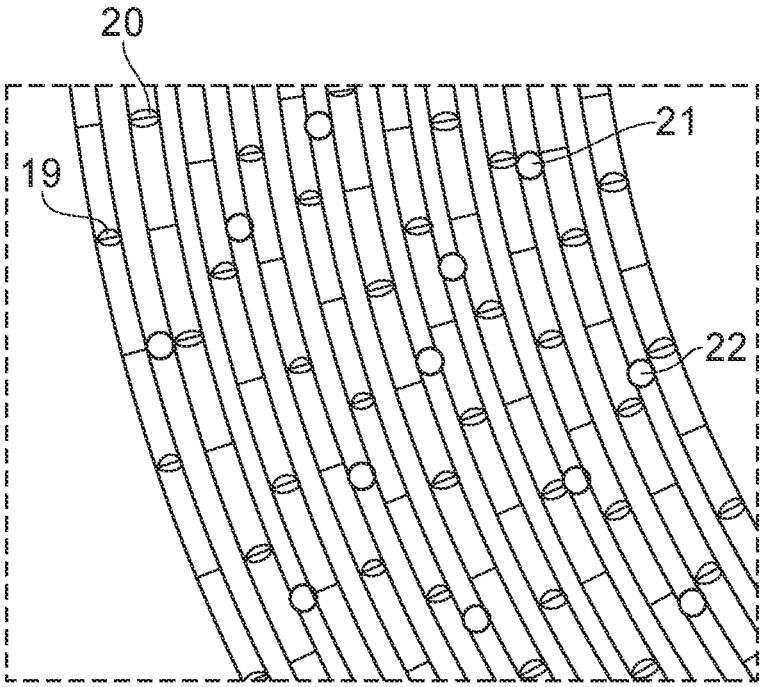
FIG. 11 shows a top-down view of the burner liner wall in FIG. 10.

As illustrated in FIGS. 9 and 11, because adjacent layers (10, 11) are out of phase, the nodes (17, 18) (19, 20) of adjacent layers are offset. That is to say, the node of one layer does not overlap with a node of an adjacent layer. Preferably, as illustrated, starting from the innermost layer, the node of the next outer layer is located such that it is generally radially aligned with the centroid of an unobscured path (void) to the centre of the burner liner passing through all of those layers radially inward thereof. Typically, the arrangement will be repeated from the innermost layer of the wall until optical opacity is achieved. The same arrangement may then be repeated through any further opacity groups located radially outwards thereof.

As will be appreciated, the number of layers required to achieve optical opacity will vary depending on the thickness (diameter) of the substantially helical struts, the number of instances per layer, the form and number of the radially extending spacers, and the diameter of the wall. Preferably about 4 or 5 layers are required to achieve optical opacity.

Preferably the substantially helical struts have a generally circular cross-section. Preferably the substantially helical struts have a diameter of from about 0.1 mm to about 1 mm, more preferably from about 0.2 mm to about 0.7 mm, 0.3 mm being an example.

Figure 10:
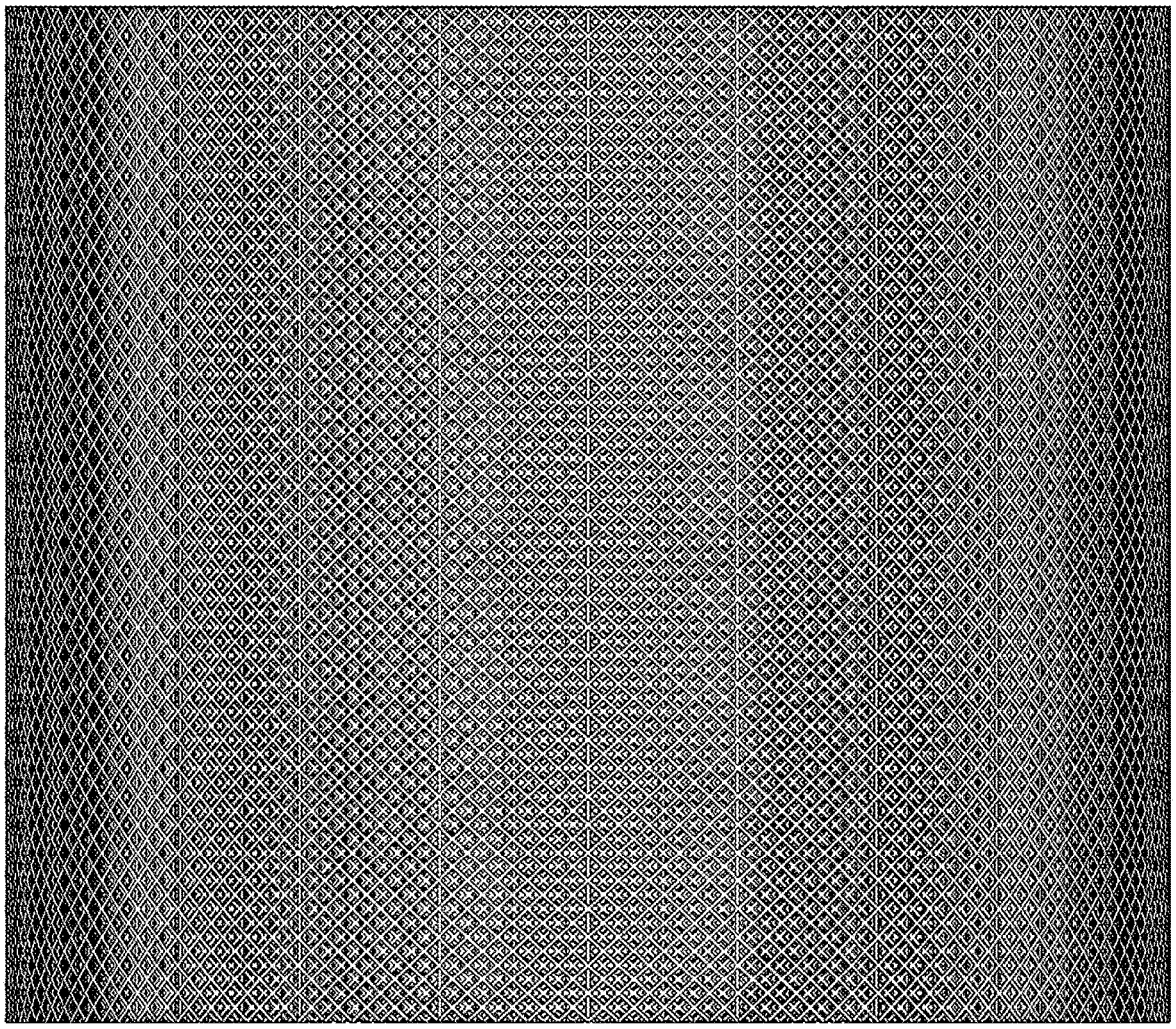
FIG. 10 shows an optically opaque wall of a foraminous burner liner.

Preferably, the wall includes at least three times the minimum number of layers needed to achieve optical opacity (i.e. at least three opacity groups). FIG. 10 shows an optically opaque wall (23) according to this embodiment.

Increasing the number of opacity groups increases the thermal path from an outermost face of the burner liner wall the to the innermost face of the burner liner wall. Preferably each opacity group repeats the same layer-to-layer offset pattern used to achieve opacity as the opacity group(s) radially inward thereof.

Advantageously, such arrangements have been found to provide desirable heat transfer properties commensurate with known burner liners.

Preferably, when present, the radially extending spacers, and in particular longitudinally extending staves (21, 22), of adjacent intermediate spacer layers may also be circumferentially offset. Such an arrangement is illustrated in FIGS. 8 and 11. Advantageously, this too may increase the thermal path and/or reduce thermal conductivity through the wall.

Figure 14:
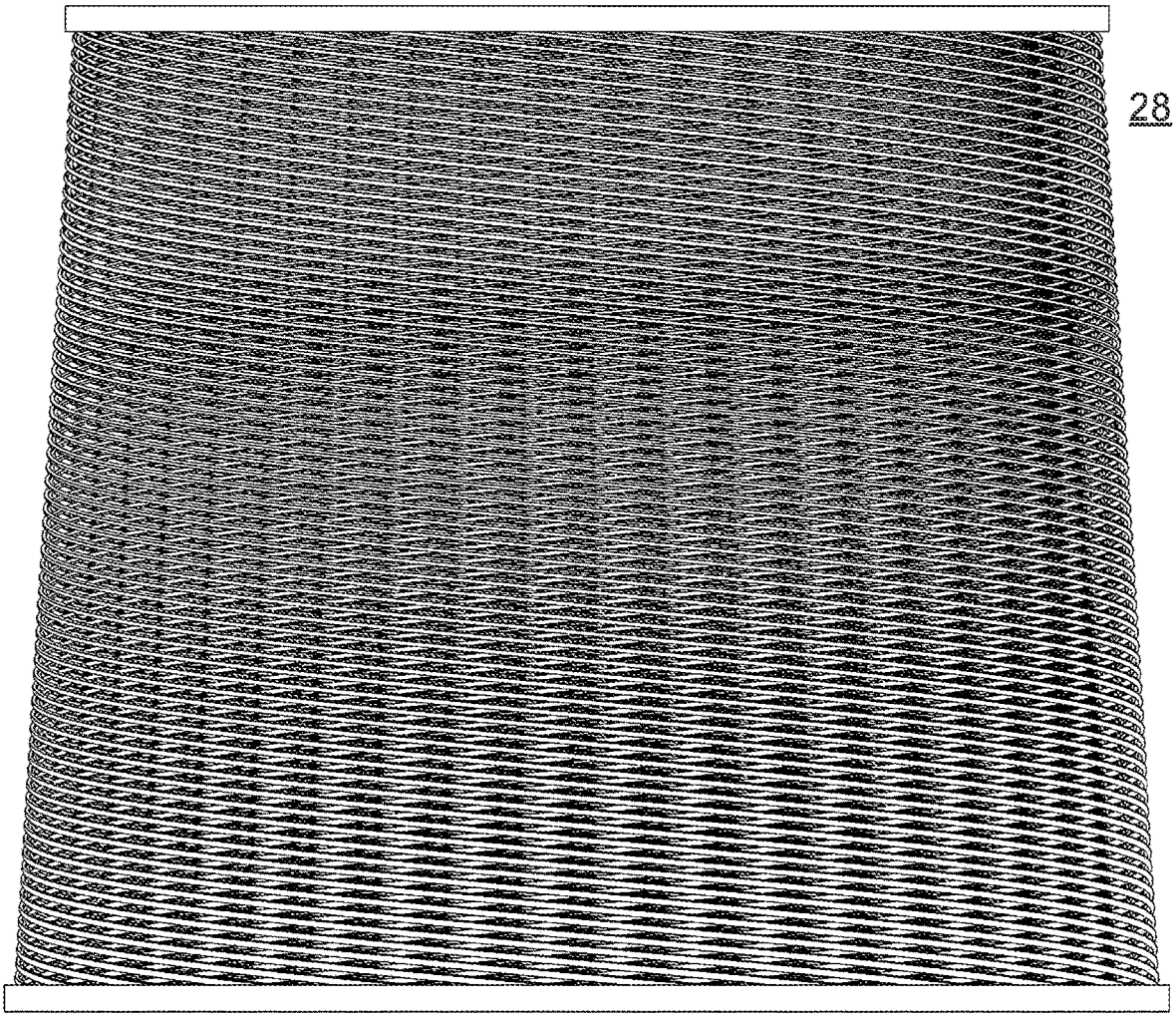
FIG. 14 shows a frustoconical burner liner.

The illustrated foraminous burner liners mentioned thus far are all substantially cylindrical tubes, although it will be appreciated that burner liners according to the invention may take other hollow body forms, such as a hollow frustoconical burner liner as shown in FIG. 14. The skilled person will appreciate helical path of the struts and shape of the repeat units may vary throughout a layer and/or between layers to accommodate non-cylindrical hollow bodies.

The inventors have also found that using uniform circular cross-sectioned struts to form a hollow frustoconical burner may result in a higher porosity at the blunt end of the taper, this being more pronounced in large aspect ratio structures. This may be addressed by varying the cross-section of the struts from one end to another. For instance, smaller helical strut diameters may be used at the narrow end of a frustoconical burner liner and lager diameter struts at the wider end thereof, or more preferably ellipse cross-sectioned helical struts of varying cross-section may be employed, or still more preferably inclined ellipse cross-sectioned struts may be used at the large end, where the angle of inclination matches the taper angle.

Figure 13:
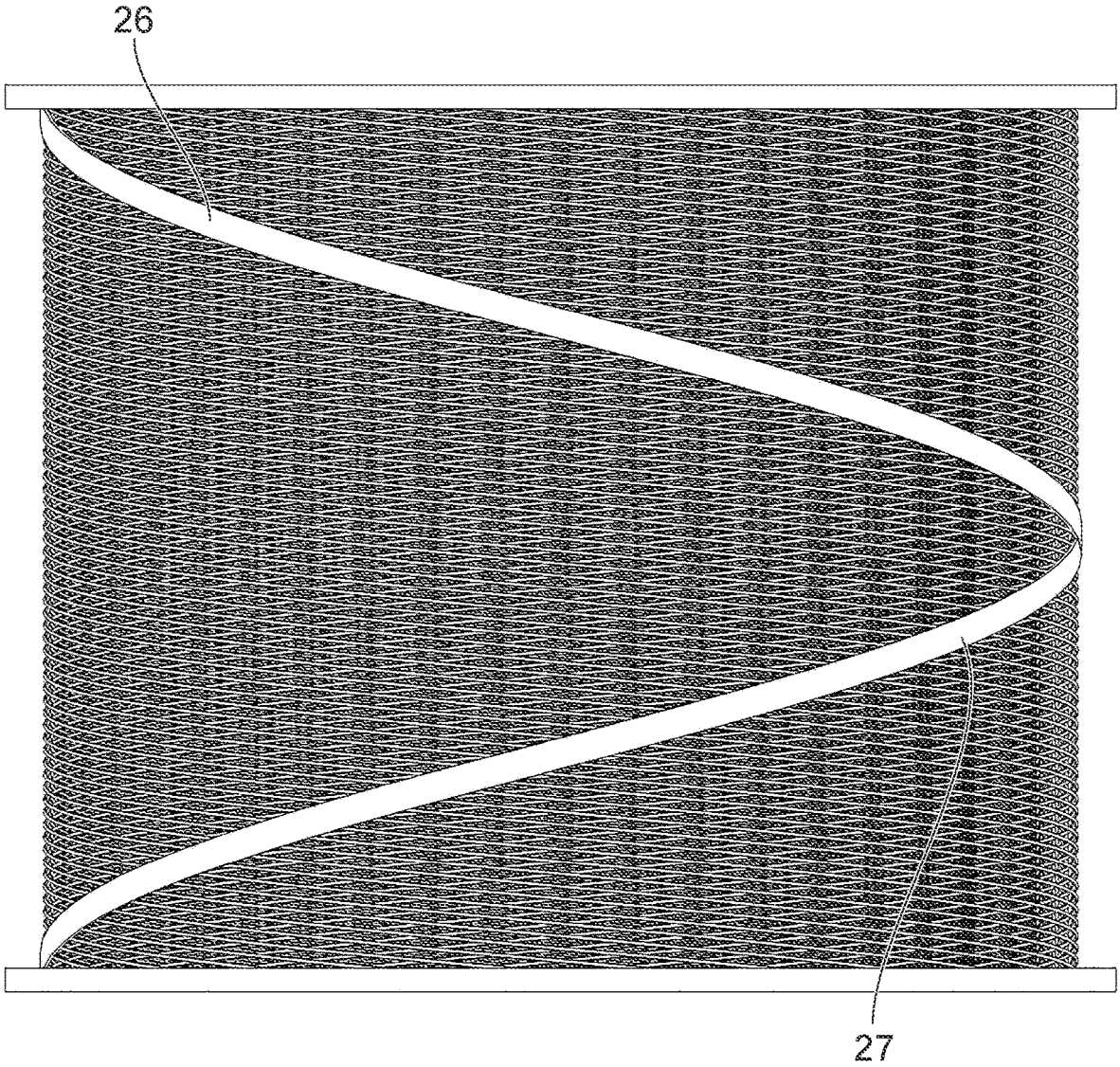
FIG. 13 shows helical tapes used to form the foil covering in FIG. 2.

Additionally, or alternatively, the foraminous burner line may further comprise one or more flow distribution elements, preferably in the form of a pair of contra-rotating helical ribbons (26, 27) as illustrated in FIG. 13.

Typically, the helical pitch and ribbon geometry are chosen such that a circular pattern of a chosen number of instances gives a controlled open area.

Figure 12:
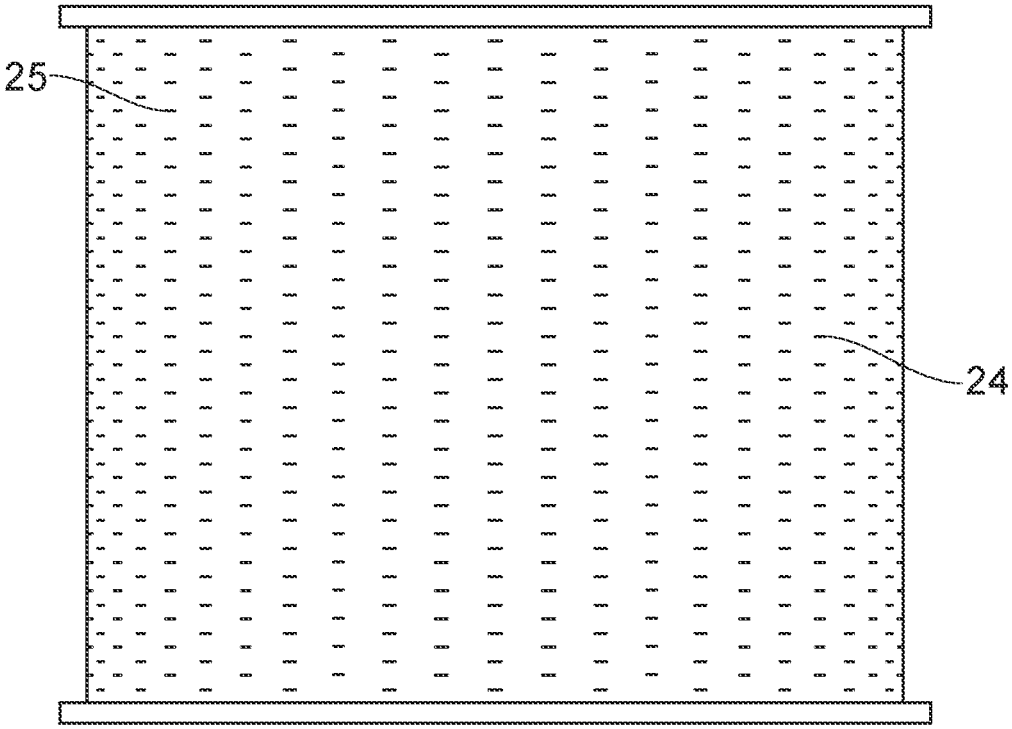
FIG. 12 shows a burner liner with an outer perforated foil covering

As shown in FIG. 12, the foraminous burner liners described herein may further comprises a perforated sheet (24) coupled to the outermost (upstream) layer of the wall, the perforated sheet defining an outer surface of the foraminous burner liner. Preferably wherein apertures (25) of the sheet are substantially aligned with voids in the outermost layer of the wall. The perforated sheet (24) may be integrally formed with the remainder of the burner liner, or subsequently coupled thereto. Additionally, or alternatively, the perforated foil may be formed from a circular pattern of contra-rotating ribbons, such as a plurality of those shown in FIG. 13.

Preferably, the flow distribution element(s) provide an open area (e.g. the area of the apertures) of about 5% and/or a pore size (e.g. aperture size) of between 0.75 $mm^2$ and 1 $mm^2$, such as 0.8 $mm^2$.

Preferably, flow distribution element, e.g. the ribbons and/or perforated sheet, is metallic, preferably comprising a metal or alloy, preferably a high temperature oxidation resistant alloy, preferably selected from the group consisting of iron-chromium-yttrium alloy, Inconel® 600 and 718, 314 stainless steel, and Iron-Chrome-Aluminium alloy.

Preferably the foraminous burner liner is a single, unitary structure. Preferably made from a single material, preferably a metallic material.

Preferably, the foraminous burner liner is additive manufactured, preferably using a powder bed fusion technique. Preferably wherein the build direction is parallel to the longitudinal axis of the foraminous burner liner.

Alternatively, the burner liner may be formed from fused wires.

Preferably, the burner liner is metallic. Preferably, the burner liner is made from a metal or alloy preferably a high temperature oxidation resistant alloy, preferably selected from the group consisting of iron-chromium-yttrium alloy, Inconel 600 and 718, and 314 stainless steel, and Iron-Chrome-Aluminium alloy.

The burner liner of the present invention may be fitted in a radiant burner of a gas abatement system, preferably for inward firing flameless combustion. The invention also provides the gas abatement system comprising foraminous burner according to the disclosed aspects and embodiments of the invention. Foraminous burner liners according to the invention may be installed during manufacture of the radiant burner, or retrofitted to pre-used radiant burners. Suitable radiant burners are described in EP1773474A and/or sold by Edwards Vacuum® under the trade name Atlas®.

For the avoidance of doubt, features of any aspects or embodiments recited herein may be combined mutatis mutandis.

It will be appreciated that various modifications may be made to the embodiments shown without departing from the spirit and scope of the invention as defined by the accompanying claims as interpreted under patent law.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A foraminous burner liner for a gas abatement system, said burner liner comprising a hollow body defined by a wall, the wall comprising a plurality of interconnected substantially concentric layers;

wherein each layer of the plurality of interconnected substantially concentric layers comprises a substantially regular openwork mesh comprising a plurality of circumferentially-spaced right-handed helical struts coupled to a plurality of circumferentially-spaced left-handed helical struts;

wherein the substantially regular openwork mesh of each layer of the plurality of interconnected substantially concentric layers is configured such that it is out of phase with one or more adjacent layers of the plurality of interconnected substantially concentric layers, and wherein the plurality of interconnected substantially concentric layers are arranged such that the wall is optically opaque when viewed externally in any radially inward direction normal to the wall;

wherein a first layer of the plurality of interconnected substantially concentric layers is connected to a second layer of the plurality of interconnected substantially concentric layers by a spacer layer comprising a plurality of circumferentially separated and longitudinally extending staves, wherein the staves are not connected to each other within the spacer layer.

2. The foraminous burner liner according to claim 1, wherein the wall comprises a greater number of interconnected substantially concentric layers than required to achieve optical opacity.

3. The foraminous burner liner according to claim 1, wherein the wall comprises from about 3 to about 20 layers.

4. The foraminous burner liner according to claim 1, wherein a right-handed substantially helical strut and a left-handed substantially helical strut of each layer of the plurality of interconnected substantially coaxial layers each complete more than one complete helix turns.

5. The foraminous burner liner according to claim 1, wherein each substantially helical strut completes a part of a helix turn, preferably less than one helix turn.

6. The foraminous burner liner according to claim 1, wherein the hollow body is substantially tubular or frustoconical.

7. The foraminous burner liner according to claim 1, wherein an outermost layer of the wall is coupled to a perforated sheet defining an outer surface of the foraminous burner liner, preferably wherein perforations of the sheet are substantially aligned with openings in the outermost layer of the wall.

8. An additive manufactured foraminous burner liner according to claim 1, preferably wherein the burner liner is manufactured using powder bed fusion.

9. A foraminous burner liner for a gas abatement system, said burner liner comprising a hollow body defined by a wall, the wall comprising a plurality of interconnected substantially concentric layers;

wherein each layer of the wall comprises a substantially regular openwork mesh;

wherein the substantially regular openwork mesh of each layer is configured such that it is out of phase with one or more adjacent layers, and wherein the wall comprises sufficient layers arranged such that the wall is optically opaque when viewed externally in any radially inward direction normal to the wall;

wherein a right-handed substantially helical strut and a left-handed substantially helical strut of each layer each complete more than one complete helix turns; and wherein a substantially helical strut of each layer intersects with and is integrally formed with a substantially helical strut of an adjacent layer.

* * * * *